United States Patent [19]

Allen, Jr.

[11] Patent Number: 4,809,035

[45] Date of Patent: Feb. 28, 1989

[54] ION DEPOSITION PRINTER WITH IMPROVED TONING UNIT ASSEMBLY INCLUDING APPARATUS FOR SEPARATING AND REMOVING NON-MAGNETIC LUBRICATING PARTICLES

[76] Inventor: Joseph M. Allen, Jr., 1186 S. Main St., West Milton, Ohio 45383

[21] Appl. No.: 70,707

[22] Filed: Jul. 7, 1987

[51] Int. Cl.[4] ..... G03G 15/08

[52] U.S. Cl. ..... 355/3 DD; 355/14 D

[58] Field of Search ..... 355/3 DD, 14 D

[56] References Cited

U.S. PATENT DOCUMENTS

| | | | |
|---|---|---|---|
| 2,843,084 | 7/1958 | Hayford | 118/637 |
| 3,645,618 | 2/1972 | Lancia et al. | 355/15 |
| 3,685,485 | 8/1972 | Kutsuwada et al. | 355/3 DD X |
| 3,914,046 | 10/1975 | Tanaka et al. | 355/15 |
| 4,026,701 | 5/1977 | Till et al. | 430/125 |
| 4,041,902 | 8/1977 | Jugle et al. | 118/653 |
| 4,121,947 | 10/1978 | Hemphill | 430/125 X |
| 4,494,129 | 1/1985 | Gretchev | 346/154 |
| 4,583,112 | 4/1986 | Morano et al. | 355/3 DD |
| 4,619,515 | 10/1986 | Maczuszenko et al. | 355/3 R |
| 4,666,282 | 5/1987 | Rowe | 355/14 D X |
| 4,692,017 | 9/1987 | Maczuszenko et al. | 355/3 DD |

OTHER PUBLICATIONS

Bickmore, John T., "Toner Emission Control Concept", Xerox Discl. Journal, vol. 1, No. 4, Apr. 1976, pp. 73–74.

*Primary Examiner*—A. C. Prescott
*Assistant Examiner*—Jane Lau
*Attorney, Agent, or Firm*—Roger S. Dybvig

[57] ABSTRACT

Substantial amounts of non-magnetic (zinc stearate) particles are removed from a supply of single component magnetic toner descending from a toner hopper before the toner reaches the image drum of an ion deposition printer. Such separation is accomplished by providing an unwanted particle chamber extending along substantially the entire width of the toner unit housing adjacent and generally below the toner hopper outlet. A blower is effective through an air manifold assembly mounted on the toner unit housing to draw the unwanted particles from such chamber.

10 Claims, 2 Drawing Sheets

FIG-1
FIG-2
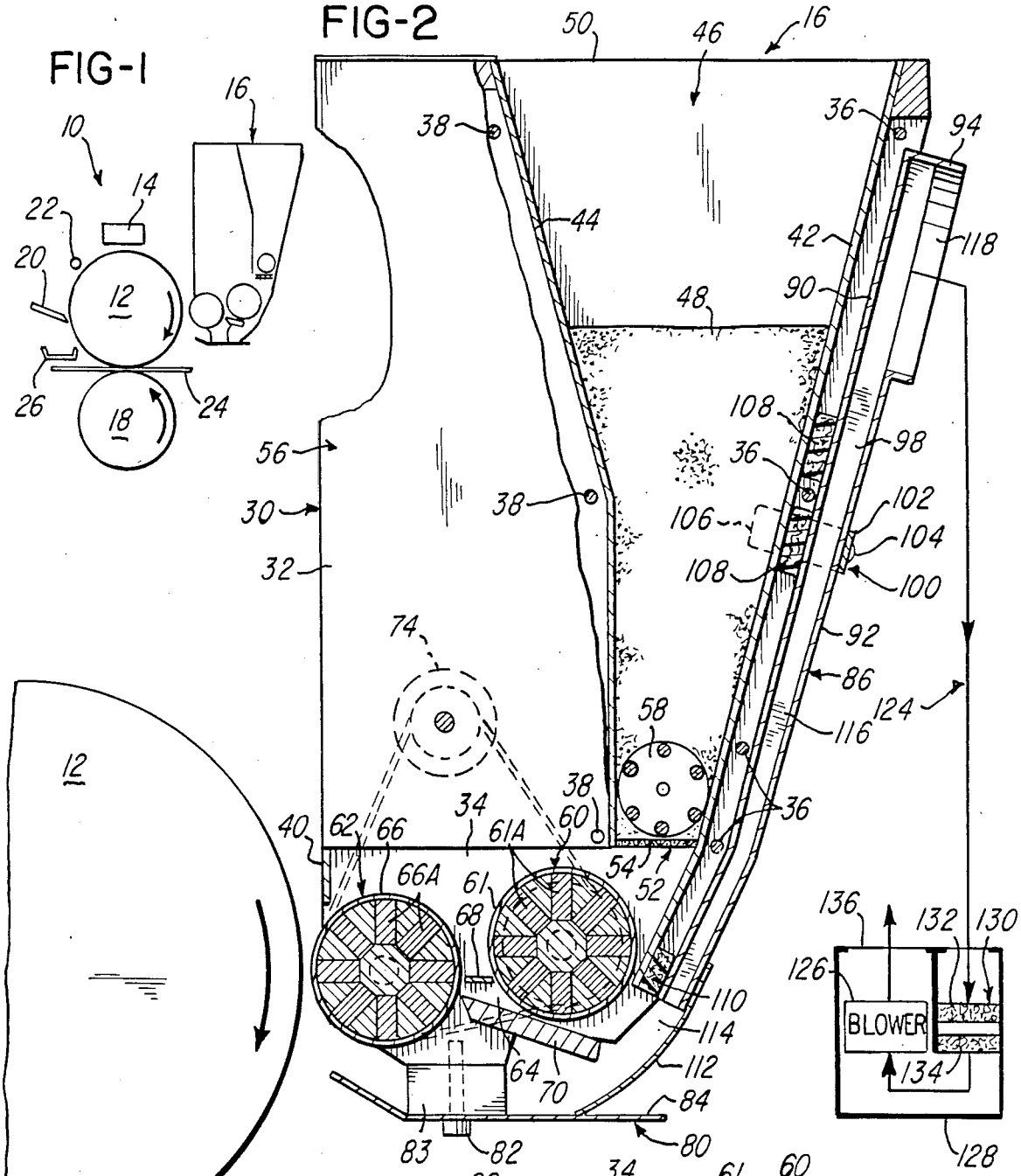
FIG-3
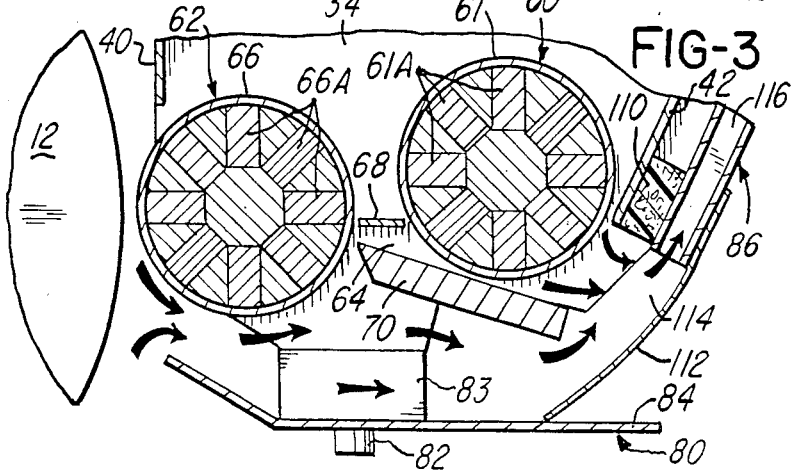

ION DEPOSITION PRINTER WITH IMPROVED TONING UNIT ASSEMBLY INCLUDING APPARATUS FOR SEPARATING AND REMOVING NON-MAGNETIC LUBRICATING PARTICLES

BACKGROUND OF THE INVENTION

This invention relates to a toning unit and separator method and apparatus especially for use with ion deposition printers utilizing a single component magnetic toner.

Although not so limited, this invention has been developed for use with an ion deposition printer using a print engine produced by Delphax Systems of Mississauga, Canada. In ion deposition printing, a digitally controlled input-output module places a charge pattern corresponding to the desired image onto the dielectric surface of a rotating, cylindrical image drum by use of an ion projection or print cartridge. Characters and other images are formed when the charged ions are arranged in a latent electrostatic dot matrix pattern on the surface of the drum. U.S. Pat. No. 4,619,515, granted to Maczuszenko et al. on Oct. 28, 1986, shows a representative ion deposition printer of the type with which this invention may advantageously be used.

Adjacent the rotating image drum there is a toning unit assembly that constitutes a source of single component toner which is attracted to the ion-charged areas of the drum. The toning unit assembly includes a housing including a toner hopper having an inlet opening to enable the toner to be poured into the hopper, an outlet opening at its lower end, a screen partly closing the outlet opening, and means for conveying toner from the hopper to the image drum including an agitator member in the bottom of the hopper that both agitates the toner in the hopper and forces toner downwardly through the screen in the outlet opening, and a rotatably-driven magnetic toner roller (for convenience termed a "toner feed roller" herein) positioned below the outlet opening to receive toner passing through the screen. A rotatably-driven second magnetic toner roller (termed a "toner applicator roller" herein) may be mounted between the toner feed roller and the image drum. The toner applicator roller receives toner from the feed roller and positions the toner for transfer to ion-charged areas of the image drum. One or more additional toner applicator rollers could also be used.

After developing the image on the drum as described above, a process called transfixing is used to transfer the toner from the drum to the paper on which the ultimate image is to be formed. In transfixing the toner and the paper are pressed together between the image drum and a pressure roller, at which time essentially all of the toner adheres to the paper.

Traces of toner remaining on the drum after transfixing are cleaned away by use of a scraper blade that scrapes any toner particles and paper dust clinging to the drum and collects them in a catch tray beneath the scraper blade. An electrostatic erase rod erases or neutralizes any charge remaining on the drum.

A preferred toner for use in ion deposition printing comprises particles of magnetic iron oxide coated with carbon black and a lubricant comprising zinc stearate. Pigmentatious material other than carbon black may be used but are not, as yet, in common use. The zinc stearate is a non-magnetic lubricant that enhances the flow characteristics of the toner and minimizes the formation of large clumps or agglomerates of toner.

Although ion deposition printers are commercially successful, and offer substantial advantages for many printing applications, experience with such printers indicates that the costs of replacement of consumable parts adds significantly to the cost of operating them. Parts that may be classed as consumables since they require frequent replacement or repair include the erase rod, the print cartridge, the image drum, and the scraper blade.

A further problem with existing ion deposition printers resides in the frequency with which the toning unit assemblies must be cleaned. When running high volumes of printing, the toning unit assemblies may have to be cleaned as often as two or three times during each eight hour shift.

Accordingly, there is a need to improve ion deposition printers to lower the cost of operation thereof by reducing the frequency with which the above noted consumables need repair or replacement, and it is an object of this invention to provide such an improved printer.

A further object of this invention is to reduce the frequency with which parts of the toning unit assembly require cleaning.

In accordance with this invention, the above objects are obtained by use of an improved method of toner delivery that includes the separation of substantial amounts of the non-magnetic (zinc stearate) particles, and perhaps magnetic particles that are so poorly attracted by magnets of the feed roller that they are effectively non-magnetic, from the toner before the toner is transferred to the image drum, and by removing the separated non-magnetic and poorly magnetic particles (jointly termed "unwanted particles" herein) from the toning unit assembly. Such separation is accomplished by providing a partly closed unwanted particle chamber extending substantially along the entire width of the hopper adjacent and below the feed roller and generally below the hopper outlet. A source of negative air flow is established across substantially the entire width of the hopper, and correspondingly across the entire length of the unwanted particle chamber, to draw the unwanted particles from the unwanted particle chamber to the source of the negative air flow. An air flow is thus created around the toner feed and applicator rollers to assist gravity in pulling the unwanted particles downwardly to the bottom of the toning unit housing and is effective to draw away a substantial portion of the unwanted particles from the toner.

By the simple expedient of separating and removing the unwanted particles from the toner in this fashion, a substantial improvement in the operation of an ion deposition printer may be obtained. In particular, the frequency with which the aforementioned consumables need replacement is dramatically reduced. Tests have indicated that the consumables lives are conservatively doubled and in some cases quintupled or more. Of course, it is to be expected that the improved characteristics will depend on the nature of the printing being done and the care taken by the operator to provide regular maintenance, such as simple cleaning operations.

A further object of this invention is to provide a toning unit assembly with an air manifold assembly including a plenum chamber opening adjacent the feed roller to the unwanted particle chamber, and to provide for the connection of a source of negative air pressure to the plenum chamber for separating the unwanted particles from the feed roller and from the unwanted particle chamber below the toner hopper outlet. The air manifold may be permanently installed on the toning unit housing but is preferably readily removably mounted on the rear of the toning unit housing so that convenient access may be had to the air manifold assembly and other parts of the toning unit assembly.

A more specific object is to provide such an air manifold assembly that does not substantially increase the dimensions of the toning unit assembly and that is lightweight. The size of the air manifold assembly is usually an important consideration because of the restrictions on available space among other parts of the printer, especially the paper feeding mechanism. A light weight air manifold is desirable so that the mounting of the toning unit assembly, which mounting is usually adjustable, will not be disturbed because of the added weight of the air manifold assembly.

Another object of this invention is to partly close the unwanted particle chamber by the rear wall of the air manifold assembly and by a collector plate provided on the bottom of the feed assembly so that particles from the toner are prevented from falling downwardly out of the feed assembly and to increase the efficiency with which the unwanted toner particles are removed from the collection chamber.

The air manifold assembly of this invention comprises a thin housing defining a plenum chamber open to a front wall backing up and substantially parallel to the rear wall of the toning unit housing. The manifold housing further includes a rear wall having a exhaust port at its upper end. The lower ends of the manifold housing front and rear walls are spaced apart to provide an inlet opening to the collection chamber. The exhaust port is preferably connected by hose to a blower located remotely from the toning unit assembly. To prevent the toner particles from fouling the atmosphere, the blower is preferably mounted in a housing having filters for cleaning the unwanted toner particles from the air drawn from the feed assembly.

The practice of this invention results in a cleaner atmosphere in and around the printer which may avoid the need to replace electronic components which otherwise may become coated and then damaged due to overheating. Use of the invention also minimizes freckling encountered in printing large dark areas. It has also been found to avoid the formation of gray areas or lines on the back of the printed paper, believed to be caused by toner transfering from the print drum to the pressure roller and then from the pressure roller to the back sides of the paper that is subsequently printed. Apparently for the same reason, acceptable quality duplex printing has not been feasible with the known ion deposition printers, but good quality duplex printing may be obtained with printers equipped with a toning unit assembly in accordance with this invention.

Use of this invention also results in the improvement of the quality of the printing obtained by ion deposition printers, particularly with regard to improvements in the sharpness of the definition and contrast obtainable.

Other objects and advantages of this invention will become apparent from the following description and the drawings.

BRIEF DESCRIPTION OF THE DRAWINGS

FIG. 1 is a highly diagrammatic and simplified view of an ion deposition printer of the type to which this invention is primarily directed.

FIG. 2 is a partly diagrammatic, partly schematic, and simplified side elevational view of the printer of FIG. 1 provided with a toning unit assembly in accordance with this invention.

FIG. 3 is an enlarged, fragmentary cross sectional view of a portion of parts of the printer including the toning unit assembly and illustrating by arrows the approximate path of air flowing through the same.

DETAILED DESCRIPTION OF THE PREFERRED EMBODIMENT

Figure 4:
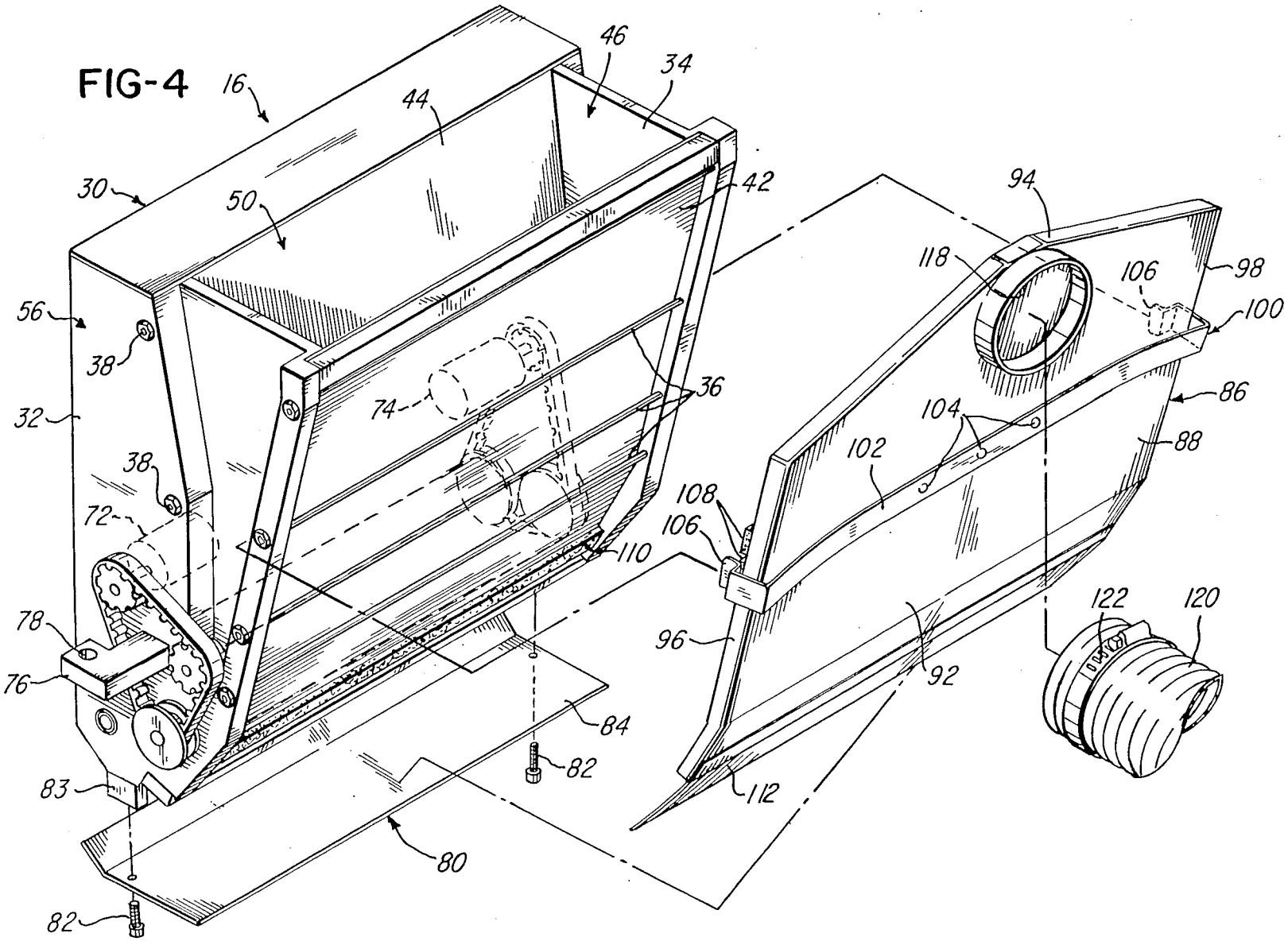
FIG. 4 is a partially exploded perspective view of a toning unit assembly of this invention.

FIG. 1 shows an ion deposition printer, generally designated 10 comprising a rotating image drum 12, an ion projection or print cartridge 14, a toning unit assembly 16, a rotating pressure roller 18, a scraper blade 20 and an erase rod 22. Paper feed means (not shown) feeds paper sheets 24 to between the image drum 12 and the pressure roller 18. Ion charged areas of the surface of the drum 12 attract toner from the feed assembly 16 and are transfixed onto the paper sheet 24 as it is pressed between the image drum 12 and the pressure roller 18. Traces of toner remaining on the surface of the drum 12 and paper particles clinging to the image drum 12 are scraped off by the scraper blade 20 and fall into a catch tray 26. The erase rod 22 electrostatically neutralizes or erases any residual charge on the surface of the drum 12. The parts as thus far described are prior art and not part of this invention. Rather, as discussed below, this invention is directed to improvements in the toning unit assembly 16.

With reference to FIGS. 2, 3, and 4, the toning unit assembly 16 comprises a housing 30 including spaced sidewalls 32 and 34, which may be cast metal, held together by plural rear connector rod assemblies 36 and plural central connector rod assemblies 38, a front plate 40 (shown only in cross section in FIGS. 2 and 3), a rear plate 42, and an intermediate divider plate 44. The rear plate 42 and the divider plate 44 cooperate with the sidewalls 32 and 34 to form a vertical toner hopper 46 for toner, designated 48. Hopper 46 has an inlet opening 50 at its upper end to enable the toner to be poured into the hopper, an outlet opening 52 at its lower end, and a screen 54 partly closing the outlet opening 52. A separate lid (not shown) is used to cover the hopper inlet opening 50.

The forward portion of the toning unit housing 30 between the front plate 40 and the intermediate plate 44 defines a motor housing 56 for drive motors that will be discussed below and for associated electronics.

Toning unit assembly 16 further includes means for conveying the toner 48 from the hopper 46 to the image drum 12 including a rotatably driven agitator drum 58 in the bottom of the hopper 46 that both agitates the toner in the bottom of the hopper 46 and forces toner downwardly through the outlet screen 54 and a rotatably-driven, elongate magnetic toner feed roller 60 positioned below the outlet opening 52 to receive toner passing through the screen 54. Toner feed roller 60 comprises a rotatable outer cylinder 61 and a separately rotatable core having a plurality of permanent magnets 61A. The toner conveying means further includes an elongate, magnetic toner applicator roller 62 mounted between the toner feed roller 60 and the image drum 12. Toner applicator roller 62 comprises a rotatable outer cylinder 66 and a rotatably fixed core having a plurality of permanent magnets 66A. Toner is fed by the feed roller 60 to a toner-receiving chamber 64 from which it is withdrawn by the applicator roller 62 and carried by its outer cylinder 66 to adjacent the image drum 12, so that the toner may be transferred to ion-charged areas thereof. Toner-receiving chamber 64 is defined at its sides by the housing sidewalls 32 and 34, on top by a transversely extending plate 68 located closely adjacent and between the two rollers 60 and 62, and on bottom by a doctor blade 70 that is adjustable by means (not shown) to meter the amount of toner picked up by the applicator roller 62. In operation, the agitator drum 58 and the outer cylinder 61 of the toner feed roller 60 are driven by a reversible drive motor 72. The direction of rotation is determined by the need for toner to be fed to the toner-receiving chamber 64, the amount of toner therein being sensed by electronic means (not shown). The outer cylinder 66 of the applicator roller 62 is constantly driven at high speed by a unidirectional drive motor 74 to maintain a supply of toner adjacent the image drum 12 at all times. The same drive motor constantly drives the assembly of magnets 61A within the roller 60. The rotation of the agitator drum 58 and parts of the rollers 60 and 62 causes the toner to be agitated to avoid the formation of toner agglomerates. The toning unit assembly 16 as thus far described is believed to be manufactured by the aforementioned Delphax Systems. It may be obtained from NBS-Anser, Inc. of 3952 Sand Shell, Fort Worth, Tex., 76137, which identifies it as a Toning Unit Assembly, part number 125-0011-002. This assembly is provided with a pair of mounting feet 76 (only one of which may be seen in FIG. 4) projecting outwardly from the sidewalls 32 and 34, each having an aperture 78. The mounting feet 76 are adopted to be rested upon mounting surfaces (not shown) to which they are clamped by mounting screws (not shown), the apertures 78 are oversized relative to the mounting screws to permit adjustment of the position of the applicator roller 62 relative to the image drum 12.

In the aforementioned commercially available toning unit, the rear wall is constructed from plural, horizontally extending and mutually overlapped plates having a resilient foam material between the overlapped top and bottom edges thereof. The lower end of the lowermost plate forming the rear wall is beneath the vertical projection of the toner feed roller, and a deflector plate at the lower end of the toning unit is spaced downwardly and forwardly of the such lowermost plate forming the rear wall. The unit is further provided with a mechanism for scraping off unwanted particles that accumulate on the top of the doctor blade 70. It is believed that the present invention, to be described below, renders the use of the scraper unit unnecessary but such may be provided if desired. Also, the rear wall 42 of the toning unit assembly 16 of this invention could also be made from overlapped plates as in the case of the commercially available unit.

In accordance with this invention, the toner housing rear wall 42 terminates at its lower end slightly below the horizontal centerline of the toner feed roller 60 and the feed assembly 16 is provided with a deflector plate 80, which may be made from sheet metal or the like material, mounted on the bottoms of the sidewalls 32 and 34 by bolts 82 and spaced beneath them by spacers 83. Deflector plate 80 has a rearwardly extending, horizontal plate portion 84 that projects rearwardly past the horizontal projection of the toner feed roller 60 and the lower end of the rear wall 42. Further, an air manifold assembly, generally designated 86, is mounted on the rear wall 42. Air manifold assembly 86 comprises a housing 88 preferably made from sheet metal and having a front wall 90, a rear wall 92, a top wall 94, and a pair of sidewalls 96 and 98. Manifold assembly 86 further comprises a mounting clip assembly 100 comprising a horizontally extending strap 102 mounted as by rivets 104 to the manifold rear wall 92 and formed at its end with forwardly extending spring fingers 106 adjacent and together straddling the manifold sidewalls 96 and 98 for gripping the margins of the hopper rear wall 42.

When mounted on the toning unit housing 30, the manifold front wall 90 lies closely adjacent and substantially parallel to the hopper rear wall 42 and its lower end is closely adjacent the lower end of the hopper rear wall 42. A pair of resilient foam plastic strips or the like vibration reducing material are adhered to the manifold front wall closely adjacent the spring fingers 106. The foam strips 108 extend completely across the manifold front wall 90 and dampen any vibration of the manifold 86 that may be encountered. Another, but lower, such strip, designated 110, extends between the bottom of the hopper rear wall 42 and the bottom of the manifold front wall 90 to further dampen vibration of the manifold assembly 88 and also to provide a seal between the hopper rear wall 42 and the manifold front wall 90. Such seal may be only partially air tight but desirably substantially restricts flow of air from between the manifold 86 and the toning unit housing 30 into the lower end of the toning unit assembly for reasons which will become apparent. The lower strip 110 may be adhered to the hopper rear wall 42, as illustrated in FIG. 4, or optionally to the manifold front wall 90.

The rear wall 92 of the manifold housing 88 is nearly parallel to and substantially coextensive with the the manifold front wall 90. The manifold assembly 88 further comprises a thin-walled, resilient skirt, designated 112, depending from the manifold rear wall and extending horizontally completely across the width of the manifold housing 88 and projecting downwardly and forwardly into engagement with the top surface of the horizontal plate portion 84 of the deflector plate 80. Skirt 112 may be constructed from stainless steel shim stock or other suitably thin and resilient material, and connected to the manifold rear wall by riveting. Skirt 112 resiliently presses against the deflector plate 80 to substantially restrict movement of air therebetween. There is thus effectively formed at the lower, rearward end of the toning unit assembly an unwanted particle chamber 114 bounded primarily by the toner feed roller 60, the lower resilient foam strip 110, the skirt 112, and the deflector plate 80. Chamber 114 is open to atmosphere at both of its ends and is also open to the area of the image drum 12 by virtue of the spacing between the deflector plate 80 and the applicator roller 62.

Manifold housing 88 defines a plenum chamber 116 which is open to the unwanted particle chamber 114 through an inlet opening formed between the mutually spaced lower ends of the manifold front wall 90 and the manifold rear wall 92. An exhaust port 118 is formed at the upper end of the manifold rear wall 92 to which is connected an exhaust hose 120 (FIG. 4) by a hose clamp 122. Hose 120 forms part of a hose assembly, schematically shown at 124 in FIG. 2, through which air and unwanted particles are drawn by an exhaust blower 126 (FIG. 2) from the unwanted particle chamber 114 and the plenum chamber 116. Blower 126 provides a source of negative air pressure that, as indicated by the arrows in FIG. 3, draws air from around the toner feed roller 60. The blower 126 operates at all times when the printer is operating. Accordingly, any non-magnetic or poorly magnetic particles which are not attracted to the toner feed roller falling or drawn downwardly by the negative air pressure will enter the unwanted particle chamber and immediately be drawn through the plenum chamber 116 to the blower 126. Also as shown by the arrows in FIG. 3, exhaust air is drawn around the doctor blade 70, the toner applicator roller 62, and the area between the applicator roller 62 and the image drum 12 to draw unwanted particles from these areas.

It may be noted that the manifold assembly 86 is quite thin, preferably less than one-half inch between the manifold front and rear walls, so that it may be mounted on the back of the housing 30 without substantially adding to its size. This is often an important consideration because the space available for the toner hopper is usually severely limited. Also, the spacing between the manifold front wall 90 and rear wall 92 tapers from a maximum at the upper end of the manifold housing 88 to a minimum at the air inlet end at the bottom edges of the manifold walls 90 and 92. Those familiar with the art will recognize that the manifold housing 88 is made in this manner to establish a uniform air flow across the entire width of the air inlet from the unwanted particle chamber 114 to the plenum chamber 116.

To avoid accidental changes in the adjustment provided by the oversized openings 78 in the mounting feet 76, the hose 120 shown in FIG. 4 is preferably of an extremely lightweight construction so that the weight of the manifold assembly 88 and the hose 120 will not so unbalance the toning unit assembly 16 that it may cause the toning unit assembly 16 to move out of adjustment. Further, and for the same reason, hose 120 is preferably flexible and attached to a fixed part of the printer (not shown). A heavier, but less expensive section of tubing or hose (not shown), may then be used to connect the lightweight hose 120 to the blower 126.

Blower 126 may be mounted in a housing 128 located remotely from the printer 10. To avoid fouling the atmosphere around the blower housing 128, a filter assembly, generally designated 130, may be mounted in the blower housing upstream of the blower 126 in the hose assembly 124. A filter assembly 130 found to be highly satisfactory is formed from a primary filter 132 having an ASHRAE test standard at 90% to 95% efficiency located upstream of a secondary filter 134 having a media rated at 99.9% for 0.3 micron particles. The output of the blower 126 may then exhaust to atmosphere through an exhaust port 136 in the blower housing 128.

The apparatus of this invention described above provides an improved method of toner delivery that includes the separation of substantial amounts of the non-magnetic (zinc stearate) particles and poorly magnetic particles from the toner before the toner is transferred to the image drum, and by removing the separated non-magnetic and poorly magnetic particles from the toner unit assembly. In practice, a toner unit assembly made in accordance with this invention with a blower creating a negative airflow calculated to be approximately 1200 feet per minute into the inlet to the plenum chamber 114 has been found to remove sufficient unwanted particles that the lives of the consumables were substantially extended and the print quality was substantially improved. Analysis of the particles removed indicates that approximately forty-five percent of the zinc stearate particles are removed from the toner. The optimum airflow rate may depend upon several factors but generally will be in the range of 500 feet per minute to 1500 feet per minute.

Although the presently preferred embodiment of this invention has been described, it will be apparent that various modifications may be made within the purview of the following claims.

I claim:

1. In an ion deposition printer having a toning unit assembly and an image drum, the improvement wherein said toning unit assembly comprises:

a toning unit housing having means forming a toner hopper having a toner outlet opening at its lower end and having a rear wall;

means forming an unwanted particle chamber in the lower rear corner of said toning unit housing beneath said outlet opening, said means including a deflector plate at the bottom of said toning unit housing;

means for conveying toner from said hopper to said image drum comprising a toner roller positioned to receive toner descending from said opening;

an air manifold housing defining a plenum chamber and including a front wall and a rear wall, the lower ends of said front wall and said rear wall of said manifold housing being mutually spaced to form an inlet between them that opens to said unwanted particle chamber in said toning unit housing, said manifold housing further having an outlet that opens at the upper end of its said rear wall;

means mounting said manifold housing on said toning unit housing with said front wall of said manifold housing closely adjacent said rear wall of said toning unit housing;

means providing a seal between said rear wall of said toning unit housing and the lower end of said front wall of said manifold housing;

said means forming an unwanted particle chamber further comprising a reilient plate connected to and depending from said rear wall of said manifold housing and resiliently pressing against the top surface of said deflector plate; and negative air pressure means connected by hose to said outlet for separating non-magnetic particles from the toner being conveyed from said hopper to said image drum and drawing said non-magnetic particles through said inlet, said plenum chamber, and said outlet.

2. The apparatus of claim 1 wherein said negative air pressure means comprises a blower remote from said toning unit housing connected by hose to said outlet.

3. In an ion deposition printer having a toning unit assembly and an image drum, the improvement wherein said toning unit assembly comprises:

a toning unit housing having means forming a toner hopper having a toner outlet opening at its lower end and having a rear wall;

means forming an unwanted particle chamber in the lower rear corner of said toning unit housing beneath said outlet opening, said means including a deflector plate at the bottom of said toning unit housing;

means for conveying toner from said hopper to said image drum comprising a toner roller positioned to receive toner descending from said opening;

an air manifold housing defining a plenum chamber and including a front wall, and a rear wall, the lower ends of said front wall and said rear wall of said manifold housing being mutually spaced to form an inlet between them that opens to said unwanted particle chamber in said toning unit housing, said manifold housing further having an outlet that opens at the upper end of its rear wall;

means mounting said manifold housing on said toning unit housing with said front wall of said manifold housing closely adjacent said rear wall of said toning unit housing comprising mounting clip means connected to said manifold housing for gripping said toning unit housing; and negative air pressure means connected by hose to said outlet for separating non-magnetic particles from the toner being conveyed from said hopper to said image drum and drawing said non-magnetic particles through said inlet, said plenum chamber, and said outlet.

4. The apparatus of claim 3 wherein said means forming an unwanted particle chamber further comprises a reilient plate connected to and depending from said rear wall of said manifold housing and resiliently pressing against the top surface of said deflector plate.

5. The apparatus of claim 4 further comprising means providing a seal between said rear wall of said toning unit housing and the lower end of said front wall of said manifold housing.

6. The apparatus of claim 3 wherein said mounting clip means is connected to said rear wall of said manifold housing between said inlet and said outlet.

7. The apparatus of claim 3 wherein said mounting clip means comprises a strap having forwardly-extending spring fingers straddling said side walls of said manifold housing.

8. The apparatus of claim 7 wherein said means forming an unwanted particle chamber further comprises a resilient plate connected to and depending from said rear wall of said manifold housing and resiliently pressing against the top surface of said deflector plate.

9. The apparatus of claim 8 further comprising means providing a seal between said rear wall of said toning unit housing and the lower end of said front wall of said manifold housing.

10. The apparatus of claim 7 wherein said mounting clip means is connected to said rear wall of said manifold housing between said inlet and said outlet.

* * * * *